United States Patent [19]

Minamitani et al.

[11] Patent Number: 4,703,735

[45] Date of Patent: Nov. 3, 1987

[54] AIR-FUEL RATIO CONTROL SYSTEM FOR MULTICYLINDER ENGINE

[75] Inventors: Kunitomo Minamitani; Masahiro Izuo; Yuji Nakao; Toshihide Nishikawa; Hiroyuki Kawaguchi, all of Hiroshima, Japan

[73] Assignee: Mazda Motor Corporation, Japan

[21] Appl. No.: 737,418

[22] Filed: May 24, 1985

[30] Foreign Application Priority Data

May 25, 1984 [JP] Japan ..... 59-106104
May 25, 1984 [JP] Japan ..... 59-106105
May 29, 1984 [JP] Japan ..... 59-109240
May 29, 1984 [JP] Japan ..... 59-109241

[51] Int. Cl.[4] ..... F02D 41/14
[52] U.S. Cl. ..... 123/489; 123/440
[58] Field of Search ..... 123/440, 489

[56] References Cited

U.S. PATENT DOCUMENTS 4,383,515 5/1983 Higashiyama et al. ..... 123/489

FOREIGN PATENT DOCUMENTS 148930 11/1979 Japan .
119140 7/1982 Japan .
101242 6/1983 Japan ..... 123/489

*Primary Examiner*—Tony M. Argenbright
*Attorney, Agent, or Firm*—Michael P. Hoffman; Michael J. Foycik; Gerald J. Ferguson, Jr.

[57] ABSTRACT

The plurality of cylinders of a multicylinder engine are divided into first group cylinders and second group cylinders, and first and second exhaust sensors are provided to respectively detect the air-fuel ratios of the intake mixtures fed to the first group cylinders and second group cylinders. The air-fuel ratio for the first group cylinders is controlled in a closed loop by a first integration signal generated based on the output of the first exhaust sensor and the air-fuel ratio for the second group cylinders is controlled in a closed loop by a second integration signal generated based on the output of the second exhaust sensor. One of the first and second integration signals is corrected so that the air-fuel ratios for the first group cylinders and second group cylinders are increased and reduced in phases reverse to each other.

13 Claims, 27 Drawing Figures

AIR-FUEL RATIO CONTROL SYSTEM FOR MULTICYLINDER ENGINE

BACKGROUND OF THE INVENTION

1. Field of the Invention

This invention relates to an air-fuel ratio control system for a multicylinder engine.

2. Description of the Prior Art

There has been known an air-fuel ratio control system for a multicylinder engine in which the air-fuel ratio in the intake mixture is detected through concentrations of exhaust emission components detected by an exhaust sensor, e.g., an oxygen sensor, disposed in the exhaust system of the engine, and closed loop control (feedback control) is effected on the air-fuel ratio in the intake mixture according to the detected air-fuel ratio.

In the known air-fuel ratio control system, an air-fuel ratio adjustment means is controlled according to an integration signal based on the output of the exhaust sensor in order to avoid abrupt change of the air-fuel ratio, and there is a certain time lag between the time intake mixture of a certain air-fuel ratio is fed to the combustion chamber and the time the air-fuel ratio of the intake mixture is detected by the exhaust sensor disposed in the exhaust system. Therefore, the actual air-fuel ratio cannot be converged on a set value, e.g., the stoichiometric air-fuel ratio, and hunting phenomenon occurs; that is, the actual air-fuel ratio periodically moves up and down across the set value. When such a hunting phenomenon occurs during idling, for example, fluctuation in torque can occur, and in the case of an engine having a catalytic convertor provided in the exhaust system, the exhaust emission cleaning properties of the catalytic convertor can be adversely affected.

In order to lessen the adverse influence of the hunting phenomenon in the closed loop control of the air-fuel ratio, there has been proposed an air-fuel ratio control system in which the cylinders of a multicylinder engine are divided into first and second groups, an exhaust sensor is provided in the exhaust system of the cylinders of the first group and the air-fuel ratio for the cylinders of the first group is controlled in a closed loop by an integration signal based on the output of the exhaust sensor, the air-fuel ratio for the cylinders of the second group being controlled by a signal obtained by inverting the integration signal for controlling the air-fuel ratio for the cylinders of the first group. That is, the air-fuel ratio for the second group cylinders is controlled by an integration signal which is reverse in phase to the integration signal for controlling the air-fuel ratio for the first group cylinders. See Japanese Unexamined Patent Publication No. 57(1982)-119140, for instance. In the air-fuel ratio control system, the air-fuel ratios for the first group cylinders and the second group cylinders fluctuate in opposite directions so that the fluctuations in torque due to the fluctuations in the air-fuel ratios for the first group cylinders and the second group cylinders cancel each other.

However, in the air-fuel ratio control system, the air-fuel ratio for the second group cylinders is controlled without detecting the actual air-fuel ratio on the presumption that the air-fuel ratio for the second group cylinders will fluctuate in the same manner as that for the first group cylinders. Even if the same fuel injection pulses are given to a plurality of fuel injection valves, for instance, the amount of fuel actually injected from each fuel injection valve differs from valve to valve due to errors in accuracy of the fuel system, errors in the volumetric efficiency of the fuel system and the like. Therefore, the air-fuel ratio for the second group cylinders may be controlled to a value far from the target value, thereby adversely affecting combustion in the cylinders, fuel economy and exhaust emission control.

SUMMARY OF THE INVENTION

In view of the foregoing observations and description, the primary object of the present invention is to provide an air-fuel ratio control system for a multicylinder engine in which the adverse influence of the hunting phenomenon substantially inherent to the closed loop control of the air-fuel ratio can be suppressed, and at the same time, accuracy in control of the air-fuel ratio can be improved.

In accordance with the present invention, a plurality of cylinders of a multicylinder engine are divided into first group cylinders and second group cylinders, and first and second exhaust sensors are provided to respectively detect the air-fuel ratios of the intake mixtures fed to the first group cylinders and second group cylinders. The air-fuel ratio for the first group cylinders is controlled in a closed loop by a first integration signal generated based on the output of the first exhaust sensor and the air-fuel ratio for the second group cylinders is controlled in a closed loop by a second integration signal generated based on the output of the second exhaust sensor. A correction means is provided to correct, for instance, one of the first and second integration signals so that the air-fuel ratios for the first group cylinders and second group cylinders are increased and reduced in phases reverse to each other.

In particular, the air-fuel ratio control system of the present invention comprises a first exhaust sensor disposed in a first exhaust system connected to first group cylinders, a second exhaust sensor disposed in a second exhaust system connected to second group cylinders, a first air-fuel ratio adjustment means for controlling the air-fuel ratio for the first group cylinders, a second air-fuel ratio adjustment means for controlling the air-fuel ratio for the second group cylinders, a closed loop control means for controlling the first and second air-fuel ratio adjustment means according to first and second integration signals generated respectively based on the outputs of the first and second exhaust sensors, and a correction means which detects at least one of the first and second integration signals and makes a correction so that the air-fuel ratios for the first and second group cylinders are increased and reduced in phases reverse to each other.

In one embodiment of the present invention, the correction means comprises a first integration signal detecting means for detecting a signal related to the direction of the first integration signal, an open loop control signal generating means which generates an open loop control signal which is reverse in phase to the first integration signal based on the output of the first integration signal detecting means, and an open loop control means which interrupts the closed control of the second air-fuel ratio adjustment means based on the output of the second exhaust sensor and controls the second air-fuel ratio adjustment means according to the open loop control signal in a particular operating condition of the engine.

The outputs (comparison outputs) of the first exhaust sensor and second exhaust sensor fluctuate as shown respectively by lines (A) and (B) in FIG. 1, for example, and the air-fuel ratios for the first group cylinders and second group cylinders are increased and reduced respectively in response to fluctuations in the outputs of the first exhaust sensor and second exhaust sensor. The outputs of the first and second exhaust sensors differ slightly from each other in timing and period of inversion upon detecting that the detected air-fuel ratio is richer or leaner than the set value. According respectively to the outputs of the first exhaust sensor and second exhaust sensor, the first integration signal and the second integration signal are generated as shown by lines (C) and (D) in FIG. 1. When the air-fuel ratios for the first group cylinders and second group cylinders are increased and reduced in response to the first and second integration signals shown by the lines (C) and (D), the engine output torque will fluctuate by a relatively large amount upon occurrence of hunting phenomenon of the air-fuel ratios for the first and second group cylinders. Therefore, according to this embodiment, the second integration signal is corrected at a predetermined time to an open loop control signal which is reverse in phase to the first integration signal as shown by the dotted portion of line (E) in FIG. 1.

Thus, in accordance with this embodiment, the air-fuel ratio for the first group cylinders is always controlled in a closed loop according to the output of the first exhaust sensor while the control of the air-fuel ratio for the second group cylinders is switched between a closed loop control according to the output of the second exhaust sensor and an open loop control by a signal which is reverse in phase to the control signal for controlling the air-fuel ratio for the first group cylinders, whereby the accuracy in controlling the air-fuel ratio for the second group cylinders can be improved and at the same time the adverse influence of the hunting phenomenon of the air-fuel ratio for the cylinders can be suppressed.

The closed loop control and the open loop control of the air-fuel ratio for the second group cylinders can be switched from one to the other in various manners. For example, the control of the air-fuel ratio for the second group cylinders may be switched after the closed loop control is accomplished for a predetermined time and the fluctuation in the air-fuel ratio is stabilized with respect to a target value. Further, the open loop control may be returned to the closed loop control after the open loop control is accomplished for a predetermined time or when it is detected that the air-fuel ratio for the second group cylinders deviates significantly from a target value.

Further, the closed loop control means may be arranged to select the output of one of the first and second exhaust sensors so that the air-fuel ratio for the cylinders corresponding to said one exhaust sensor is controlled in a closed loop and the air-fuel ratio for the cylinders corresponding to the other exhaust sensor is controlled in an open loop.

In another embodiment of the present invention, the correction means comprises an integration signal detecting means for detecting the first and second integration signals, and an integration signal correcting means for correcting at least one of the integration signals according to the output of the integration signal detecting means so that the air-fuel ratios for the first group cylinders and second group cylinders are increased and reduced in phases reverse to each other.

In one preferred embodiment of the present invention, the integration signal correcting means measures the time the first and second integration signals are in the same phase and changes the integration constant (gain) of one of the integration signals according to the result of the measurement as shown by lines (F), (G) and (H) in FIG. 1.

In another preferred embodiment of the present invention, the integration signal correcting means measures the time the first and second integration signals are in the same phase and temporarily holds one of the integration signals so that the air-fuel ratios for the first group cylinders and second group cylinders are increased and reduced in phases reverse to each other as shown by lines (I), (J) and (K) in FIG. 1.

In still another preferred embodiment of the present invention, the integration signal correcting means holds one of the integration signals when the integration signal is inverted and releases the integration signal when the other integration signal is inverted in the direction opposite to the direction of the inversion of said one integration signal at the time it is held as shown by lines (L), (M) and (N) in FIG. 1.

The air-fuel ratio control system of the present invention can be applied to multicylinder engines of various types such as the V-type engine and the in-line engine. In the case of a V-type engine, the cylinders of one cylinder bank may be the first group cylinders and the cylinders of the other cylinder bank may be the second group cylinders, for example.

Further, the air-fuel ratio adjustment means may be either of the fuel injection type in which the air-fuel ratio is controlled by controlling the amount of fuel to be injected from a fuel injection valve, or of the carburetor type in which the air-fuel ratio is controlled by controlling the amount of bleeding air in a carburetor.

BRIEF DESCRIPTION OF THE DRAWINGS

FIGS. 5, 5A and 5B are a flow chart for illustrating the operation of the control unit of an air-fuel ratio control system in accordance with a third embodiment of the present invention.

DESCRIPTION OF THE PREFERRED EMBODIMENTS

Figure 2:
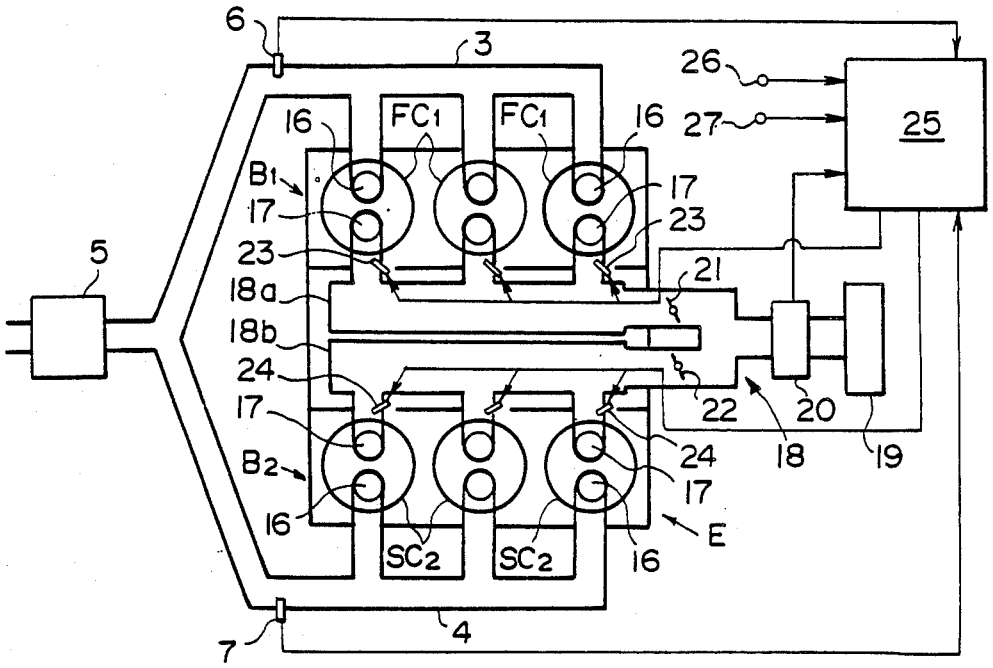
FIG. 2 is a schematic view of a V-6 engine provided with an air-fuel ratio control system in accordance with the present invention.

In FIG. 2, a V-6 engine E provided with an air-fuel ratio control system in accordance with the present invention has first and second cylinder banks B1 and B2 respectively having cylinders FC1 and SC2. Exhaust ports 16 of the cylinders FC1 of the first cylinder bank B1 are connected to a first exhaust system 3 and exhaust ports 16 of the cylinders SC2 of the second cylinder bank B2 are connected to a second exhaust system 4. The first and second exhaust systems 3 and 4 are connected together and a catalytic convertor (three-way convertor) 5 is provided downstream of the junction of the first and second exhaust systems 3 and 4. The first and second exhaust systems 3 and 4 are respectively provided with first and second exhaust sensors 6 and 7 which may comprise an oxygen sensor, for instance. That is, the cylinders FC1 of the first cylinder bank B1 form one group and the cylinders SC2 of the second cylinder bank B2 form the other group described above. The cylinders FC1 will be sometimes referred to as "first group cylinders", and the cylinders SC2 will be sometimes referred to as "second group cylinders", hereinbelow.

Intake ports 17 of the first and second group cylinders FC1 and SC2 are connected to an intake system 18. The intake system 18 includes an air-cleaner 19, an airflow sensor 20 disposed downstream of the air-cleaner 19 and first and second intake passages 18*a* and 18*b* which are respectively connected to the intake ports 17 of the first and second group cylinders FC1 and SC2 at one end and are connected together downstream of the airflow sensor 20. The first and second intake passages 18*a* and 18*b* are respectively provided with throttle valves 21 and 22 near the connection thereof. A portion of the intake system 18 downstream of the throttle valves 21 and 22 forms a surge tank, and discrete intake passages extend from the surge tank portion to the respective cylinders FC1 and SC2. The throttle valves 21 and 22 are opened and closed by the same angle in synchronization with each other.

A first fuel injection valve 23 is provided in each of the discrete intake passages extending between the surge tank portion and the respective first group cylinders FC1 and a second fuel injection valve 24 is provided in each of the discrete intake passages extending between the surge tank portion and the respective second group cylinders SC2. The first and second fuel injection valves 23 and 24 are controlled by a control unit 25 to control the amount of fuel to be fed to the corresponding cylinders according to the operating condition of the engine E. The control unit 25 may comprise a microcomputer, for instance.

To the control unit 25 are inputted detected air-fuel ratio signals from the first and second exhaust sensors 6 and 7, an intake air amount signal from the airflow sensor 20, an engine speed signal from an engine rpm sensor 26 and a coolant temperature signal from an engine coolant temperature sensor 27.

Figure 3:
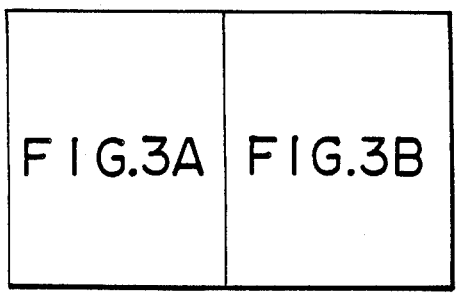
FIGS. 3, 3A and 3B are a flow chart for illustrating the operation of the control unit of an air-fuel ratio control system in accordance with a first embodiment of the present invention.
Figure 3B:
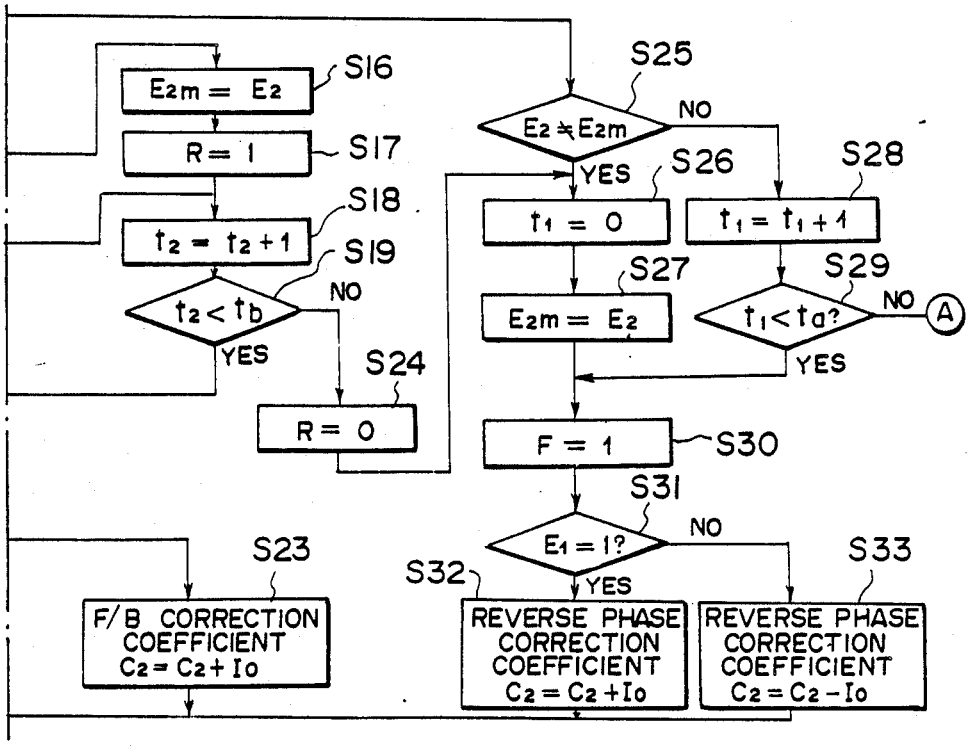
Figure 3A:
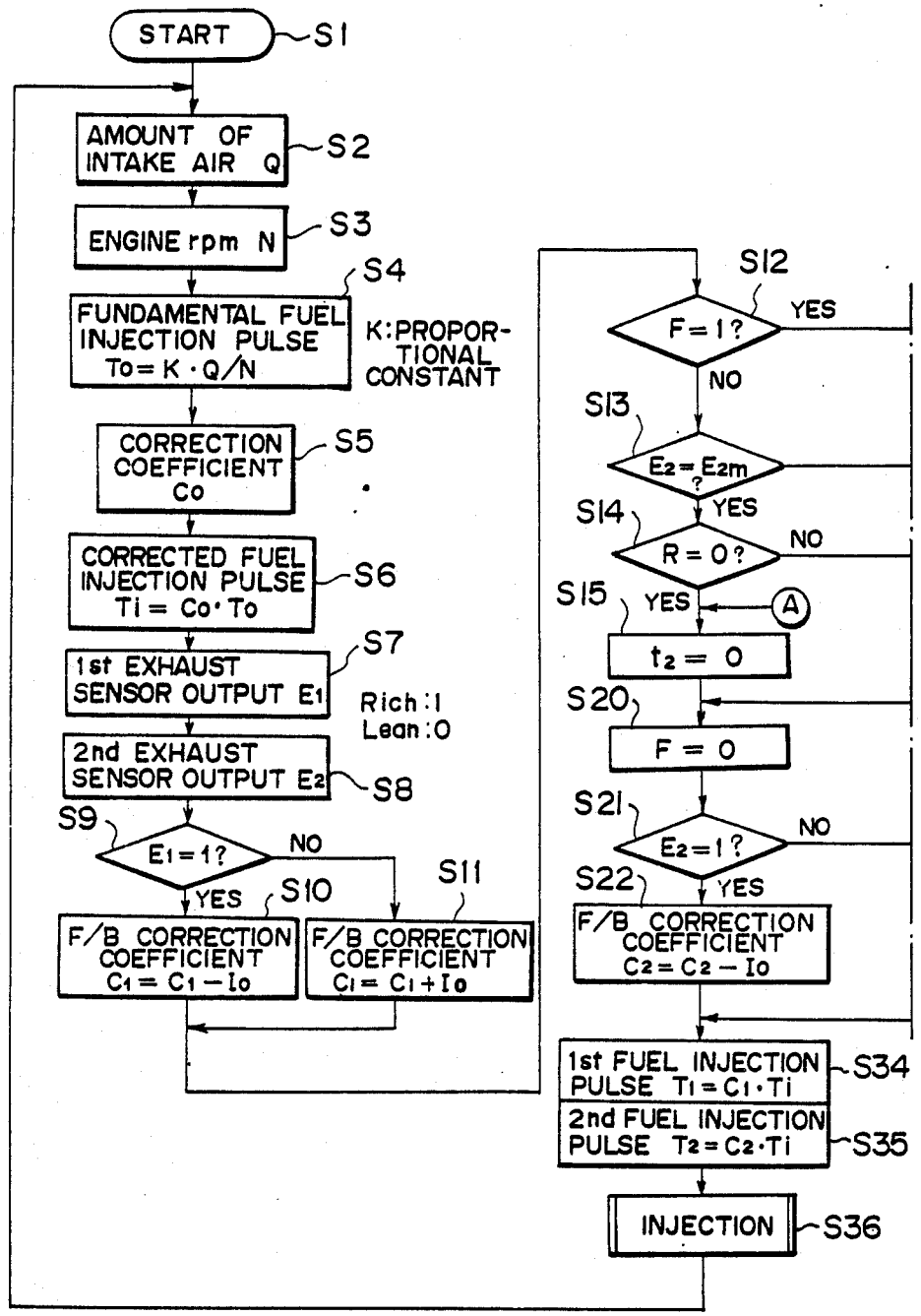

FIG. 3 is a flow chart showing the operation of the control unit 25 in the case of an air-fuel ratio control system in accordance with a first embodiment of the present invention in which the air-fuel ratios for the first and second group cylinders are controlled in accordance with the principle described above in conjunction with the lines (C), (D) and (E).

In step S1, timers $t_1$ and $t_2$, and flags F and R are reset (initialized), and then the amount Q of intake air and the engine speed N are read in steps S2 and S3. In step S4, a fundamental fuel injection pulse To to be delivered to the first and second fuel injection valves 23 and 24 is calculated corresponding to a fuel amount requirement. In step S5, a correction coefficient Co for, for instance, temperature correction according to the output of the engine coolant temperature sensor 27, starting correction, acceleration correction or the like is obtained and then corrected fuel injection pulse Ti is calculated in step S6.

In step S7, comparison output E1 of the first exhaust sensor 6 is read, and in step S8, comparison output E2 of the second exhaust sensor 7 is read. The comparison outputs E1 and E2 are "1" signals when the detected air-fuel ratio is richer than a set value, and are "0" signals when the detected air-fuel ratio is leaner than the set value.

In step S9, it is determined whether or not the detected air-fuel ratio for the first group cylinders is richer than the set value. When it is determined that the detected air-fuel ratio for the first group cylinders is richer than the set value, a correction coefficient C1 is calculated by subtracting an integration constant Io so that the air-fuel ratio is lowered in step S10. When it is determined that the air-fuel ratio is leaner than the set value in the step S9, the correction coefficient C1 is obtained by adding the integration constant Io in step S11. A first integration signal for the closed loop control of the air-fuel ratio for the first group cylinders is obtained based on the correction coefficient C1.

In step S12, it is determined whether or not the flag F is set at 1. The fact that the flag F is set at 1 means that the air-fuel ratio for the second group cylinders is controlled in open loop by an integration signal which is reverse in phase to that for controlling the air-fuel ratio for the first group cylinders. On the other hand, the fact that the flag F is set at 0 means that the air-fuel ratio for the second group cylinders is controlled in closed loop independently.

When it is determined that the flag F is set at 0 in the step S12, it is determined in step S13 whether or not said comparison output E2 of the second exhaust sensor 7 is equal to the preceding comparison output E2m of the second exhaust sensor 7 stored in a memory. That is, in the step S13, it is determined whether or not the detected air-fuel ratio is inverted with respect to the set value from the leaner side to the richer side or from the richer side to the leaner side. When it is determined that the comparison output E2 is equal to the preceding comparison output E2m in the step S13, it is then determined whether or not the flag R is reset in step S14.

The fact that the flag R is set at 1 means that the comparison output E2 of the second exhaust sensor 7 has been once inverted, while the fact that the flag R is set at 0 means that the comparison output E2 has not been inverted yet. When it is determined that the flag R is set at 0 in the step S14, the second timer $t_2$ is reset in step S15 and then the flag F is reset in step S20. Thereafter, the control unit 25 proceeds to step S21. In the step S21, it determined whether or not the detected air-fuel ratio for the second group cylinders is richer than a set value through the comparison output E2 of the second exhaust sensor 7. When it is determined that the detected air-fuel ratio for the second group cylinders is richer than the set value, a correction coefficient C2 is calculated by subtracting the integration constant Io so that the air-fuel ratio is lowered in step S22. On the other hand, when it is determined that the detected air-fuel ratio for the second group cylinders is leaner than the set value in the step S21, the correction coefficient C2 is obtained by adding the integration constant Io in step S23. A second integration signal for the closed loop control of the air-fuel ratio for the second group cylinders is obtained based on the correction coefficient C2.

Based on the correction coefficient C1 (the first integration signal) obtained in the step S10 or S11, and the correction coefficient C2 (the second integration signal) obtained in the step S22 or S23, final fuel injection pulse T1 for the first group cylinders and a final fuel injection pulse T2 for the second group cylinders are calculated respectively in steps S34 and S35. According to the final fuel injection pulses T1 and T2, the first fuel injection valves 23 for the first group cylinders and the second fuel injection valves 24 for the second group cylinders are driven to inject fuel. The air-fuel ratio for the first and second group cylinders is thus controlled in a closed loop.

When the comparison output E2 of the second exhaust sensor 7 is inverted for the first time in the closed loop control described above, the control unit 25 proceeds to step S16 after the step S13. In the step S16, the control unit 25 rewrites the memory. Thereafter, the control unit 25 sets the flag R at 1 in step S17, and counts the second timer $t_2$ in step S18. After the comparison output E2 of the second exhaust sensor is once inverted, the determination of the step S13 or S14 becomes "no" irrespective of whether or not the comparison output E2 is inverted again, and count of the second timer $t_2$ in the step S18 is accomplished.

In step S19, it is determined whether or not the count of the second timer $t_2$ is not longer than a predetermined time interval tb. When the determination of the step S19 is "yes", the closed loop control of the air-fuel ratio for the second group cylinders is continued, and otherwise the control unit 25 proceeds to step S24 to reset the flag R. Thereafter, the control unit 25 proceeds to step S26 in a reverse phase process routine.

In the step S26, the first timer $t_1$ is reset at 0. The memory of the second comparison output E2 is rewritten in step S27, and the flag F is set at 1 in step S30. Then in steps S31 to S33, a reverse phase integration signal is obtained. In the step S31, as in the step S9, it is determined whether the air-fuel ratio for the first group cylindrs is richer than the set value through the comparison output E1 of the first exhaust sensor. When it is determined that the air-fuel ratio for the first group cylinders is richer than the set value, the correction coefficient C2 is obtained by, reversely to the step S10, adding the integration coefficient Io so that the air-fuel ratio is enriched in the step S32. Otherwise, the correction coefficient C2 is obtained by, reversely to the step S11, subtracting the integration constant Io so that the air-fuel ratio is lowered in the step S32. Based on the correction coefficient C2 thus obtained, a second integration signal for controlling the air-fuel fuel ratio for the second group cylinders in an open loop is obtained. The second integration signal is reverse in phase to the first integration signal for controlling the air-fuel ratio for the first group cylinders. Based on the correction coefficients C1 and C2 thus obtained, a final fuel injection pulse T1 for the first group cylinders and a final fuel injection pulse T2 for the second group cylinders are calculated in steps S34 and S35. According to the final fuel injection pulses T1 and T2, the first fuel injection valves 23 for the first group cylinders and the second fuel injection valves 24 for the second group cylinders are driven to inject fuel. Thus, the air-fuel ratio for the first group cylinders is controlled in a closed loop while the air-fuel ratio for the second group cylinders is controlled in an open loop, and the air-fuel ratio for the second group cylinders is increased and reduced in a reverse phase to the air-fuel ratio for the first group cylinders.

In the reverse phase open control of the air-fuel ratio for the second group cylinders, it is determined whether or not the comparison output E2 of the second exhaust sensor 7 has been inverted in step S25. When it is determined that the comparison output E2 has been inverted in the step S25, the first timer $t_1$ is reset in step S26, and otherwise, the first timer $t_1$ is counted in step S28. The first timer $t_1$ is continued to be counted until the comparison output E2 is inverted. In step S29, it is determined whether or not the count $t_1$ of the first timer $t_1$ is not longer than a predetermined time interval ta. When the determination of the step S29 is "yes", the reverse phase open control of the air-fuel ratio for the second group cylinders is continued, and otherwise the control unit 25 proceeds to the step S15 in the closed loop processing routine. In the step S15, the second timer $t_2$ is reset at 0, and closed control is effected following the steps S21 to S23 after the flag F is reset at 0 in the step S20.

The determination of the step S29 is "no" when the comparison output E2 of the second exhaust sensor 7 is not inverted within the predetermined time interval, that is, when the air-fuel ratio for the second group cylinders deviates far from the set value so that the air-fuel ratio for the second group cylinders cannot be moved across the set value from the richer side to the leaner side or from the leaner side to the richer side under the reverse phase open loop control of the air-fuel ratio for the second group cylinders. In such a case, the reverse phase open loop control of the air-fuel ratio for the second group cylinders is interrupted and the control of the air-fuel ratio for the second group cylinders is switched to the closed loop control to correct the air-fuel ratio for the second group cylinders to the set value.

Though in the flow chart shown in FIG. 3, the control of the air-fuel ratio for the second group cylinders is switched between the closed loop control and the open loop control according to the operation of the timers $t_1$ and $t_2$, the control may be switched in other manners. For example, the reverse phase open loop control may be accomplished when the number of inversions of the comparison output E1 of the first exhaust sensor 6 and the number of inversions of the comparison output E2 of the second exhaust sensor 7 are nearly the same (considering that the air-fuel ratio of the second group cylinders is not far from the set value). On the other hand when the number of inversions of the comparison output E1 of the first exhaust sensor 6 differs from that of the comparison output E2 of the second exhaust sensor 7 by a large amount, the closed loop control of the air-fuel ratio for the second group cylinders (together with the closed loop control of the air-fuel ratio for the first group cylinders) may be accomplished (considering that the air-fuel ratio for the second group cylinders is apart from the set value).

Further, when the control is switched from the closed loop control to the open loop control, the reverse phase open loop control may be accurately accomplished corresponding to the reference value (the average value) of the second integration signal in the preceding closed loop control.

Further, the integration constant Io for calculating the first and second integration signals may differ in value depending on whether the air-fuel ratio is increased or reduced, or depending on which integration signal is to be calculated.

Figure 1:
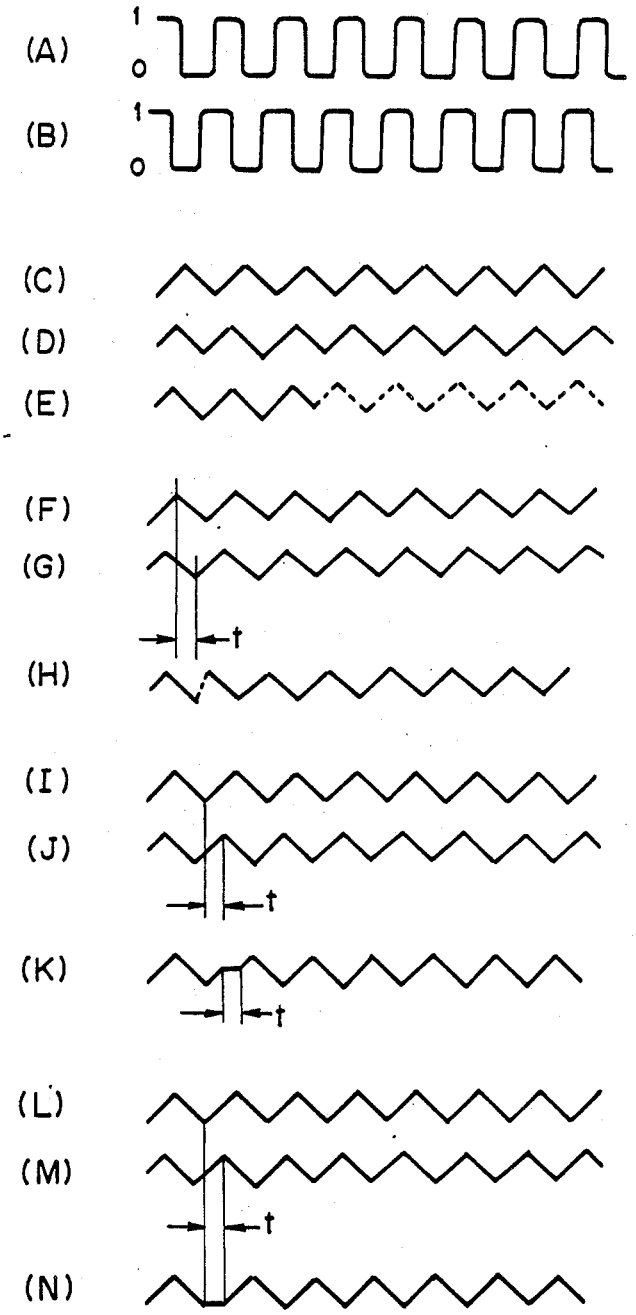
FIGS. 1A-1N show a view for illustrating the principle of operation of air-fuel ratio control systems in accordance with various embodiments of the present invention.
Figure 4:
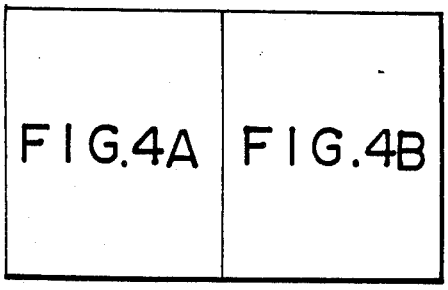
FIGS. 4, 4A and 4B are a flow chart for illustrating the operation of the control unit of an air-fuel ratio control system in accordance with a second embodiment of the present invention.
Figure 4B:
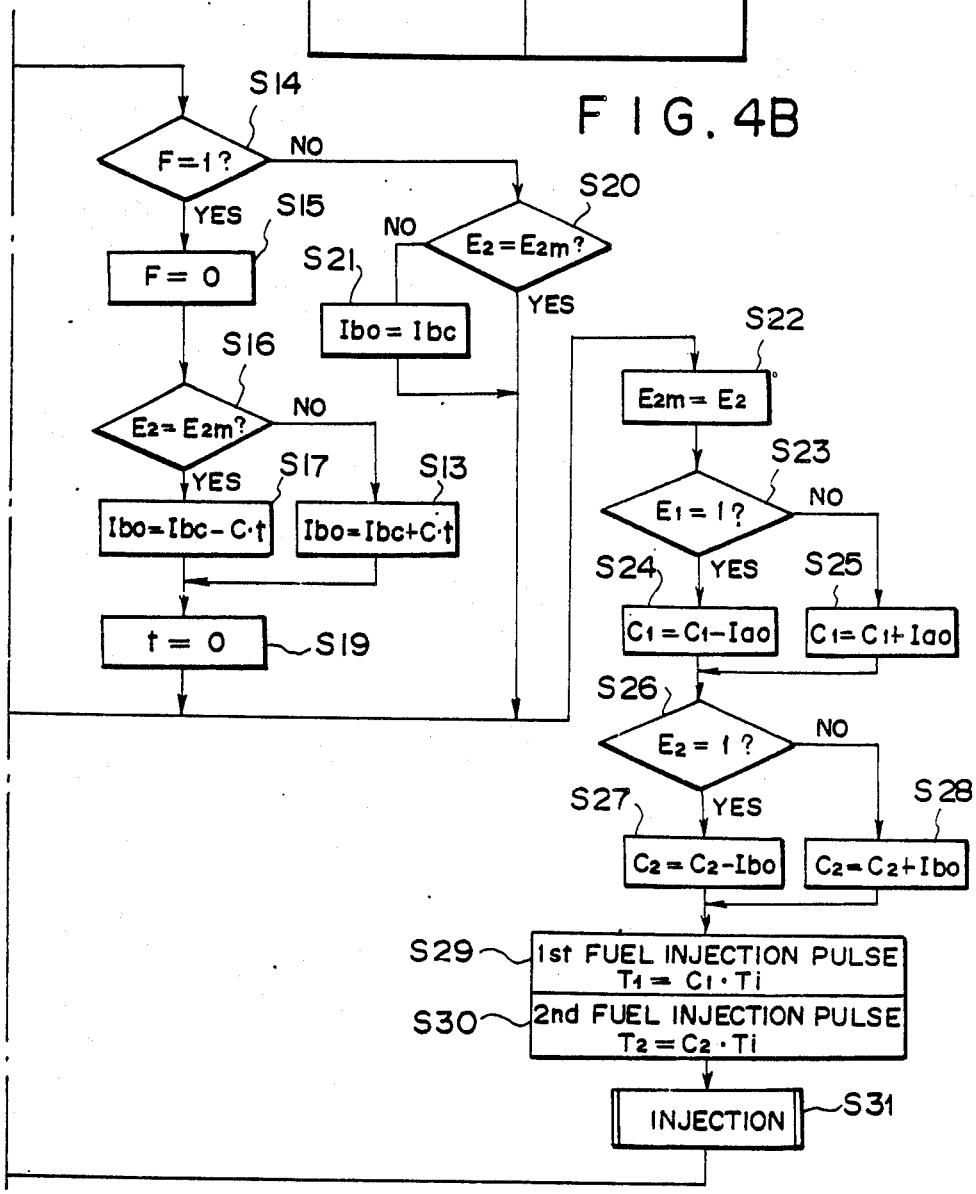
Figure 4A:
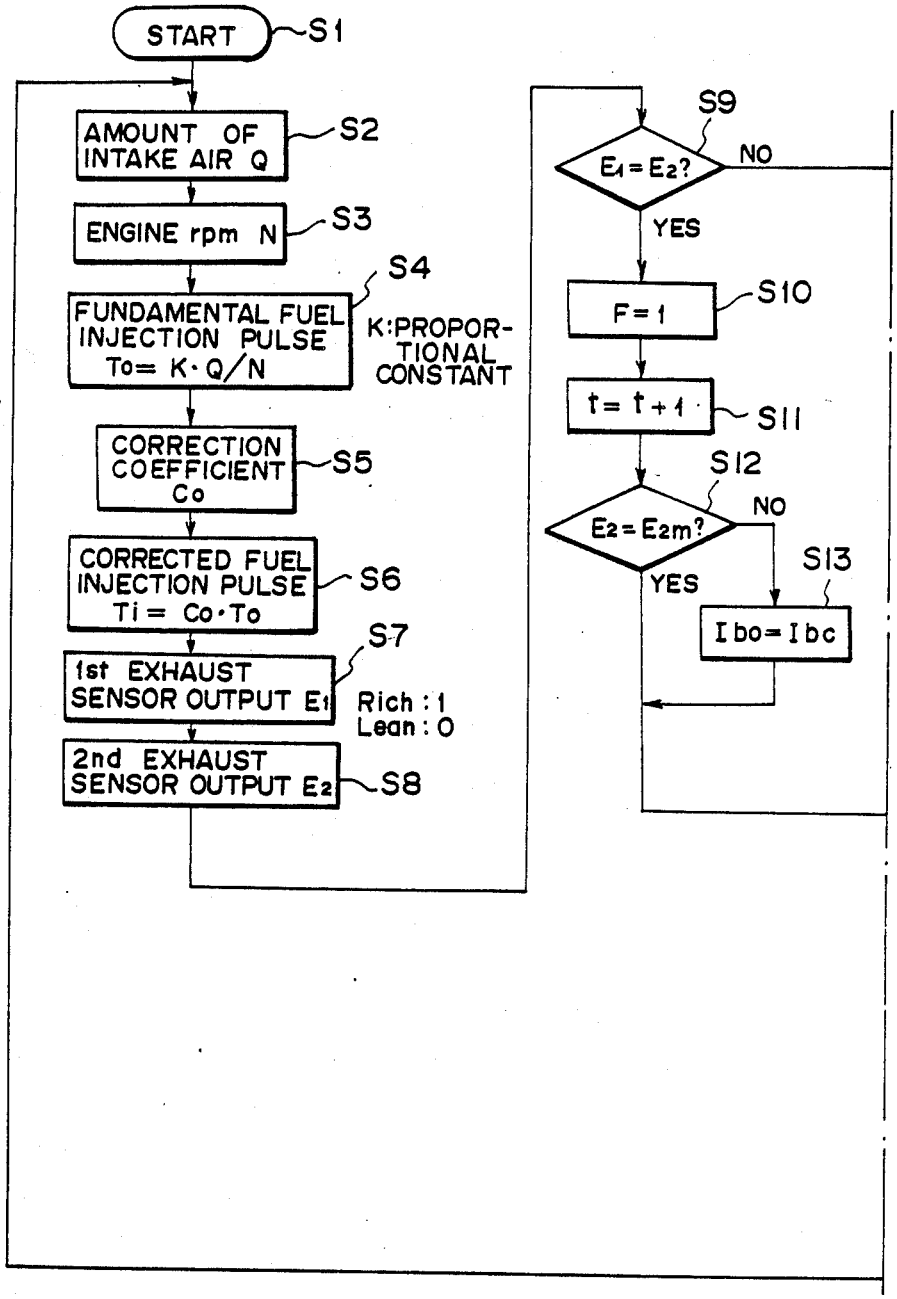

FIG. 4 is a flow chart showing the operation of the control unit 25 in the case of an air-fuel ratio control system in accordance with a second embodiment of the present invention in which the air-fuel ratios for the first and second group cylinders are controlled in accordance with the principle described above in conjunction with the lines (F), (G) and (H) in FIG. 1.

In step Sl, timer t and flag F are reset (initialized), and then the amount Q of intake air and the engine speed N are read in steps S2 and S3. In step S4, a fundamental fuel injection pulse To to be delivered to the first and second fuel injection valves 23 and 24 is calculated corresponding to a fuel amount requirement. In step S5, a correction coefficient Co for, for instance, temperature correction according to the output of the engine coolant temperature sensor 27, starting correction, acceleration correction or the like is obtained and then corrected fuel injection pulse Ti is calculated in step S6.

In step S7, comparison output E1 of the first exhaust sensor 6 is read, and in step S8, comparison output E2 of the second exhaust sensor 7 is read. The comparison outputs E1 and E2 are "1" signals when the detected air-fuel ratio is richer than a set value, and are "0" signals when the detected air-fuel ratio is leaner than the set value.

In step S9, it is determined whether or not the comparison outputs E1 and E2 are in the same phase (both of them are 0 or both of them are 1). When determination of the step S9 is "yes", that is, when it is determined that the comparison outputs E1 and E2 are in the same phase, the flag F (to be described later) is set at 1, and then timer t is counted. The timer t is for measuring the time interval during which the comparison outputs E1 and E2 are in the same phase. When the determination of the step S9 is "no", it is determined whether or not the flag F is set at 1 in step S14. The fact that the flag F is set at 1 means that an integration constant Ibo for obtaining the second integration signal for controlling the air-fuel ratio for the second group cylinders has not been corrected. On the other hand, the fact that the flag F is reset at 0 means that the integration constant Ibo has been corrected. When it is determined that the flag F is set at 1 or when it is determined that the integration constant Ibo has not been corrected (the phases of the comparison outputs E1 and E2 become reverse to each other for the first time) in the step S14, the flag F is reset at 0 in step S15. Thereafter it is determined in step S16 whether or not said comparison output E2 of the second exhaust sensor 7 is equal to the preceding comparison output E2m of the second exhaust sensor 7 stored in a memory. That is, in the step S16, it is determined whether or not the detected air-fuel ratio is inverted with respect to the set value from the leaner side to the richer side or from the richer side to the leaner side, thereby determining whether the reverse phase condition is caused by inversion of the comparison output E1 of the first exhaust sensor or by inversion of the comparison output E2 of the second exhaust sensor.

When it is determined that the comparison output E2 is equal to the preceding comparison output E2m in the step S16, the integration constant Ibo is corrected, in step S17, by subtracting the product of the time interval t of the timer t and a constant C from a reference integration constant Ibc so that the inversion timing of the second integration signal generated based on the output of the second exhaust sensor is delayed to be synchronized with the inversion timing of the output of the first exhaust sensor, the time interval t of the timer t representing the time interval by which the inversion of the output of the first exhaust sensor is delayed from the inversion of the output of the second exhaust sensor. On the other hand when the determination of the step S16 is "no", the integration constant Ibo is corrected, in step S18, by adding the product of the time interval t of the timer t and the constant C to the reference integration constant Ibc so that the inversion timing of the second integration signal is advanced to be synchronized with the inversion timing of the first integration signal, the time interval t representing the time interval by which the inversion of the output of the second exhaust sensor is delayed from the inversion of the output of the first exhaust sensor.

After the correction of the integration constant Ibo, the timer t is reset at 0 in step S19, and the memory of the second comparison output E2 is rewritten in step S22. In step S23 it is determined whether the air-fuel ratio for the first group cylinders is richer than the set value through the comparison output E1 of the first exhaust sensor. When it is determined that the air-fuel ratio for the first group cylinders is richer than the set value, the correction coefficient C1 is obtained by adding the integration constant Iao so that the air-fuel ratio is enriched in step S25. Otherwise, the correction coefficient C1 is obtained by subtracting the integration constant Iao so that the air-fuel ratio is lowered in step S24. Based on the correction coefficient C1 thus obtained, the first integration signal for the closed loop control of the air-fuel ratio for the first group cylinders is obtained.

In step S26, it is determined whether the air-fuel ratio for the second group cylinders is richer than the set value through the comparison output E2 of the second exhaust sensor. When it is determined that the air-fuel ratio for the second group cylinders is richer than the set value, the correction coefficient C2 is obtained by adding the corrected integration constant Ibo so that the air-fuel ratio is enriched in step S28. Otherwise, the correction coefficient C2 is obtained by subtracting the corrected integration constant Ibo so that the air-fuel ratio is lowered in step S27. Based on the correction coefficient C2 thus obtained, the second integration signal for the closed loop control of the air-fuel ratio for the second group cylinders is obtained.

Based on the correction coefficient C1 (first integration signal) obtained in the step S24 or S25 and the correction coefficient C2 (second integration signal) obtained in the step S27 or S28, a final fuel injection pulse T1 for the first group cylinders and a final fuel injection pulse T2 for the second group cylinders are calculated in steps S29 and S30. According to the final fuel injection pulses T1 and T2, the first fuel injection valves 23 for the first group cylinders and the second fuel injection valves 24 for the second group cylinders are driven to inject fuel. Thus, the air-fuel ratios for the first and second group cylinders are controlled in a closed loop and at the same time, by correction of the integration constant Ibo of the second integration signal, the air-fuel ratio for the second group cylinders is increased and reduced in reverse phase to the air-fuel ratio for the first group cylinders.

After the correction of the integration constant Ibo, the determination of the step S14 turns to "no" since the flag F is reset at 0 in the step S15. Thereafter, the control unit 25 proceeds to step S20. In the step S20, it is determined whether or not the comparison output E2 of the second exhaust sensor 7 was inverted. When it is determined that the comparison output E2 was inverted, the corrected integration constant Ibo is returned to the reference integration constant Ibc and the closed loop control is accomplished, while when it is not determined that the comparison output was inverted, the closed loop control is accomplished with the corrected integration constant Ibc.

In the reverse phase control described above, when one of the outputs of the first and second exhaust sensor is inverted earlier than the other so that the outputs of the exhaust sensors are in the same phase, the determination of the step S9 turns to "yes". In this case, the flag F is set at 1 in step S10, and count of the timer t is initiated in step S11. Further, it is determined whether or not the comparison output E2 was inverted in step S12. When it is determined that the comparison output E2 was inverted, the integration constant Ibo is returned to the reference integration constant.

Thus, when the comparison outputs E1 and E2 come to be in the same phase, the time the comparison outputs E1 and E2 are in the same phase is measured and the integration constant Ibo of the second integration signal is fixed according to the result of the measurement, whereby the change in the air-fuel ratio for the second group cylinders is retarded or advanced so that the air-fuel ratios for the first and second group cylinders are increased and reduced in reverse phases. Thus, the air-fuel ratios for the first and second group cylinders are controlled in a closed loop maintaining the reverse phase condition.

Further, the integration constants Iao and Ibo for calculating the first and second integration signals may differ in value depending on whether the air-fuel ratio is increased or reduced.

Figure 5:
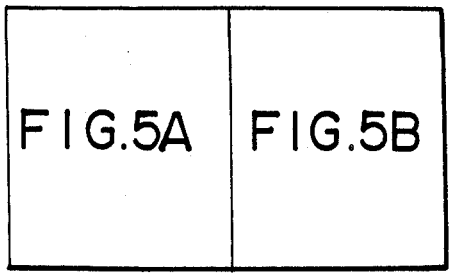
Figure 5:
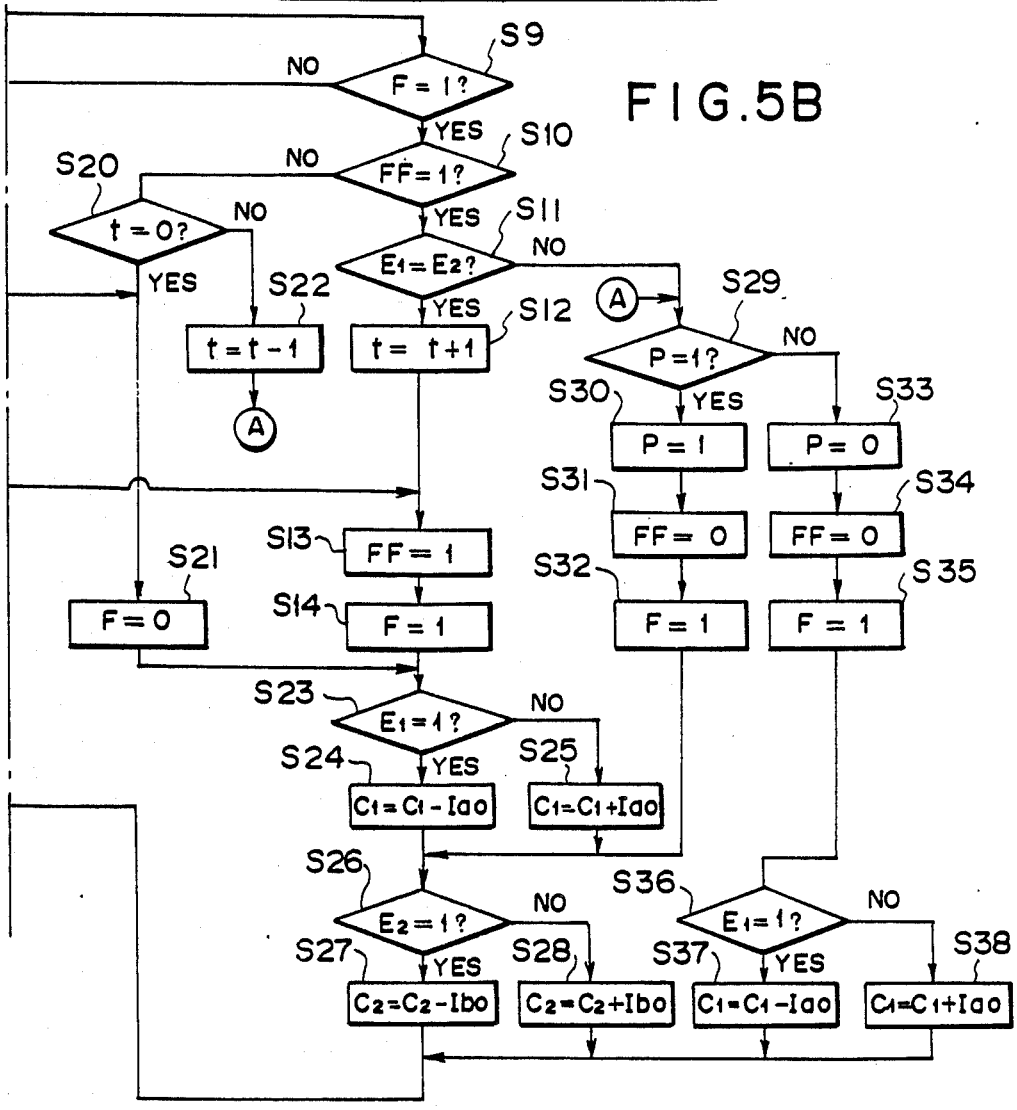
Figure 5A:
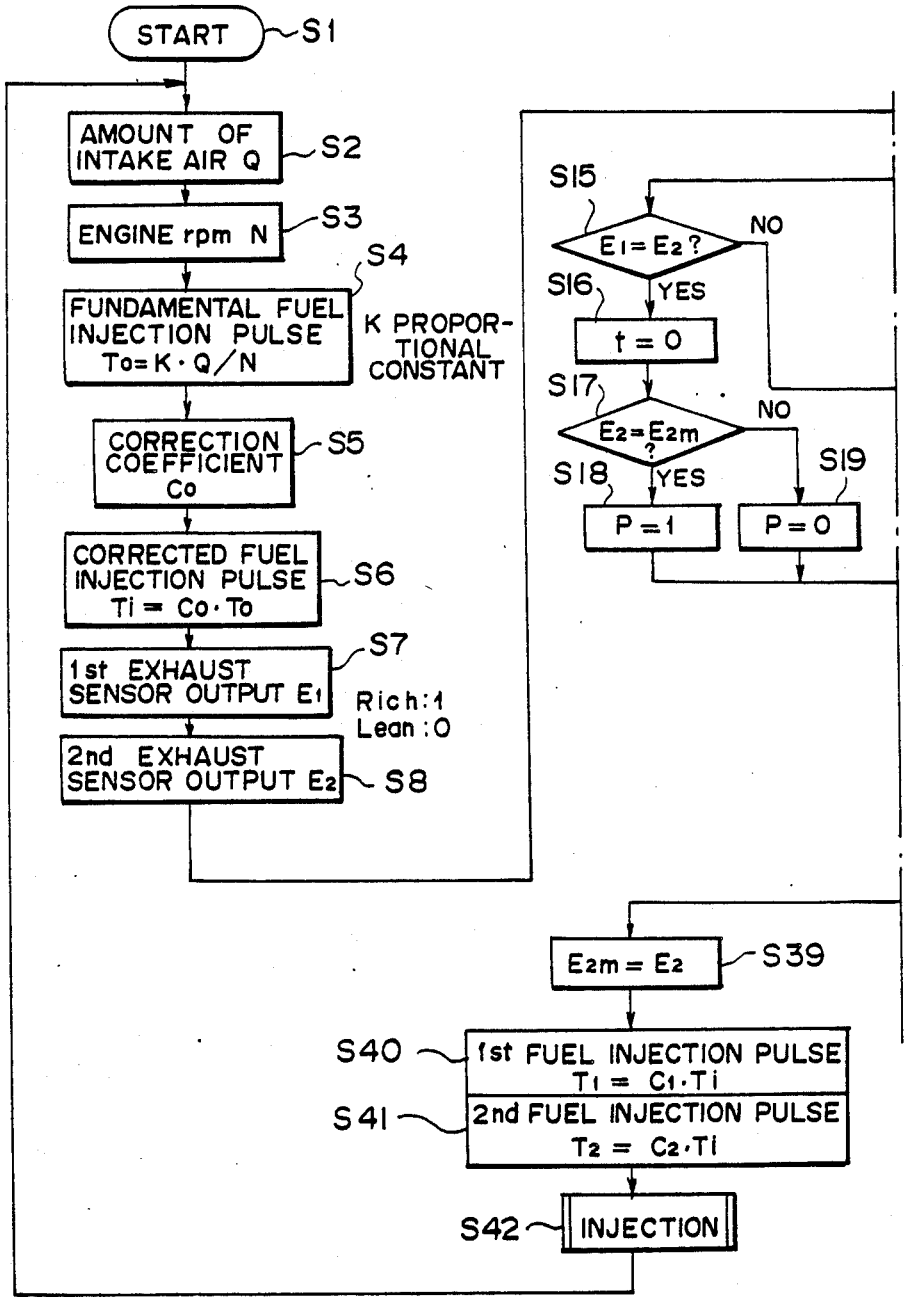

FIG. 5 is a flow chart showing the operation of the control unit 25 in the case of an air-fuel ratio control system in accordance with a third embodiment of the present invention in which the air-fuel ratios for the first and second group cylinders are controlled in accordance with the principle described above in conjunction with the lines (I), (J) and (K) in FIG. 1.

In step Sl, timer t and flag F are reset (initialized), and then the amount Q of intake air and the engine speed N are read in steps S2 and S3. In step S4, a fundamental fuel injection pulse To to be delivered to the first and second fuel injection valves 23 and 24 is calculated corresponding to a fuel amount requirement. In step S5, a correction coefficient Co for, for instance, temperature correction according to the output of the engine coolant temperature sensor 27, starting correction, acceleration correction or the like is obtained and then corrected fuel injection pulse Ti is calculated in step S6.

In step S7, comparison output E1 of the first exhaust sensor 6 is read, and in step S8, comparison output E2 of the second exhaust sensor 7 is read. The comparison outputs E1 and E2 are "1" signals when the detected air-fuel ratio is richer than a set value, and are "0" signals when the detected air-fuel ratio is leaner than the set value.

In step S9, it is determined whether or not the first flag F is set at 1. When the first flag F is set at 1, the timer t is being counted, while when the flag F is reset at 0, the timer t is reset.

In step S10, it is determined whether or not a second flag FF is set at 1. When the second flag FF is set at 1, the timer t is adding, while when the second flag FF is reset at 0, the timer t is subtracting.

When the determination of the step S9 is "no" and the timer t is reset, the comparison output E1 of the first exhaust sensor 6 and the comparison output E2 of the second exhaust sensor 7 are compared with each other and it is determined whether or not they are in the same phase (both of them are 1 or 0) in step S15. When it is determined that the comparison outputs E1 and E2 are in reverse phases, i.e., the determination in the step S15 is "no", the flag F is reset at "0" in step S21. Thereafter, in step S23 it is determined whether or not the air-fuel ratio for the first group cylinders is richer than the set value through the comparison output E1 of the first exhaust sensor 6. When it is determined that the air-fuel ratio for the first group cylinders is richer than the set value, the correction coefficient C1 is obtained by subtracting the integration constant Iao so that the air-fuel ratio is reduced in step S24. Otherwise, the correction coefficient C1 is obtained by adding the integration constant Iao so that the air-fuel ratio is enriched in step S25. Based on the correction coefficient C1 thus obtained, the first integration signal for the closed loop control of the air-fuel ratio for the first group cylinders is obtained.

In step S26, it is determined whether or not the air-fuel ratio for the second group cylinders is richer than the set value through the comparison output E2 of the second exhaust sensor 7. When it is determined that the air-fuel ratio for the second group cylinders is richer than the set value, the correction coefficient C2 is obtained by subtracting the integration constant Ibo so that the air-fuel ratio is reduced in step S27. Otherwise, the correction coefficient C2 is obtained by adding the integration constant Ibo so that the air-fuel ratio is enriched in step S28. Based on the correction coefficient C2 thus obtained, the second integration signal for the closed loop control of the air-fuel ratio for the second group cylinders is obtained.

In step S39, memory of the second comparison output E2 is rewritten. Thereafter, based on the correction coefficient C1 (first integration signal) obtained in the step S24 or S25 and the correction coefficient C2 (second integration signal) obtained in the step S27 or S28, a final fuel injection pulse T1 for the first group cylinders and a final fuel injection pulse T2 for the second group cylinders are calculated in steps S40 and S41. According to the final fuel injection pulses T1 and T2, the first fuel injection valves 23 for the first group cylinders and the second fuel injection valves 24 for the second group cylinders are driven to inject fuel. Thus, the air-fuel ratios for the first and second group cylinders are controlled in a closed loop.

In the reverse phase control described above, when one of the outputs of the first and second exhaust sensors 6 and 7 is inverted earlier than the other so that the outputs of the exhaust sensors are in the same phase, the determination of the step S15 turns to "yes". In this case, the timer t is reset in step S16. Thereafter it is determined in step S17 whether or not said comparison output E2 of the second exhaust sensor 7 is equal to the preceding comparison output E2m of the second exhaust sensor 7 stored in a memory. That is, in the step S17, it is determined whether or not the detected air-fuel ratio is inverted with respect to the set value from the leaner side to the richer side or from the richer side to the leaner side, thereby determining whether the same phase condition is caused by inversion of the comparison output E1 of the first exhaust sensor 6 or by inversion of the comparison output E2 of the second exhaust sensor 7.

When it is determined that the comparison output E2 is equal to the preceding comparison output E2m in the step S17, it is considered that the comparison output E1 of the first exhaust sensor 6 is inverted earlier than that of the second exhaust sensor 7. Therefore, a third flag P is set at 1 in step S18 to hold the first integration signal so that the inversion timing of the first integration signal generated based on the output of the first exhaust sensor 6 is delayed to be synchronized with the inversion timing of the output of the second exhaust sensor 7.

When it is not determined that the comparison output E2 is equal to the preceding comparison output E2m in the step S17, it is considered that the comparison output E2 of the second exhaust sensor is inverted earlier than that of the first exhaust sensor 6. Therefore, the third flag P is reset at 0 in step S19 to hold the second integration signal so that the inversion timing of the second integration signal generated based on the output of the second exhaust sensor 7 is delayed to be synchronized with the inversion timing of the output of the first exhaust sensor 6.

After the integration signal to be held is determined by setting the third flag P, the second flag FF is set at 1 to cause the timer t to add in step S13, and the first flag F is set at 1 to cause the timer to operate in step S14. Thereafter, closed loop control is accomplished following the steps S23 to S28 and the steps S39 to S41.

When the comparison outputs E1 and E2 come to be in the same phase, the determinations of the steps S9 and S10 both turn to "yes". Accordingly, the control unit 25 proceeds to the step S11 and further to the step S12 since the determination of the step S11 is of course "yes". In the step S12, the timer t is added. This addition of the timer t is continued so long as the comparison outputs E1 and E2 are in the same phase.

When one of the outputs of the first and second exhaust sensors 6 and 7 is inverted and the outputs come to be in the reverse phases while the timer t is adding, the determination of the step S11 turns to "no" and in step S29, it is determined whether or not the third flag P set in the step S18 or S19 is at 1.

In the case that the first integration signal is to be held, the determination of the step S29 is "yes" (P=1). Accordingly, the flag P is set at 1 again in step S30, and at the same time, the second flag FF is reset at 0 in step S31 to cause the timer t to subtract. Thereafter, the control unit 25 proceeds to the step S26 after setting the flag F at 1 in the step S32. Thus, the closed loop control of the second integration signal corresponding to the comparison output of the second exhaust sensor 7 is accomplished while the closed loop control of the first integration signal is interrupted and the correction coefficient C1 for the first integration signal is fixed.

In the case that the second integration signal is to be held, the determination of the step S29 is "no" (P=0). Accordingly, the flag P is reset at 0 again in step S33, and at the same time, the second flag FF is reset at 0 in step S34 to cause the timer t to subtract. Thereafter, the control unit 25 proceeds to the step S36 after setting the flag F at 1 in the step S35. The steps S36 to S38 are the same as the steps S23 to S25, and the closed loop control of the first integration signal is accomplished while the closed loop control of the second integration signal is interrupted and the correction coefficient C2 for the second integration signal is fixed.

When the hold of the first integration signal or the second integration signal begins, the second flag FF is reset at 0. Accordingly, the determination of the step S10 turns to "no" and the control unit 25 proceeds to step S20. In the step S20, it is determined whether or not the count of the timer t is 0. When the count of the timer t is not 0, the count of the timer t is subtracted in step S22 and then the control unit 25 proceeds to the step S29 to continue the hold of one of the integration signals.

When the count of the timer t is subtracted for the time corresponding to the count value by which the timer t is added in the same phase condition, and the count of the timer t is nullified, the determination of the step S20 turns to "yes" and the control unit 25 proceeds to step S21. In the step S21, flag F is reset at 0 and the reverse phase closed loop control with the first and second integration signals is initiated again.

Thus, when the comparison outputs E1 and E2 come to be in the same phase, the time the comparison outputs E1 and E2 are in the same phase is measured and one of the first and second integration signals is fixed according to the result of the measurement, whereby the change in the air-fuel ratio for the first group cylinders or the second group cylinders is held so that the air-fuel ratios for the first and second group cylinders are increased and reduced in the reverse phases. Thus, the air-fuel ratios for the first and second group cylinders are controlled in a closed loop maintaining the reverse phase condition.

Though in the embodiment shown in FIG. 5, one of the first and second integration signals is held depending on the inversion timing in order to shorten the holding time, the integration signal to be held may be fixed for the first integration signal or the second integration signal irrespective of the inversion timing.

Further, the integration constants Iao and Ibo for calculating the first and second integration signals may differ in value depending on whether the air-fuel ratio is increased or reduced.

Figure 6:
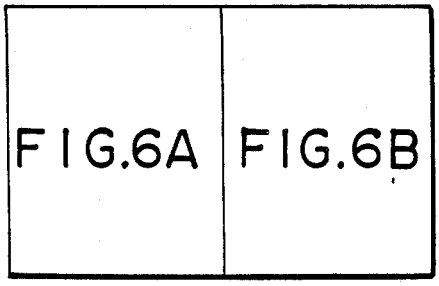
FIGS. 6, 6A and 6B are a flow chart for illustrating the operation of the control unit of an air-fuel ratio control system in accordance with a fourth embodiment of the present invention.
Figure 6B:
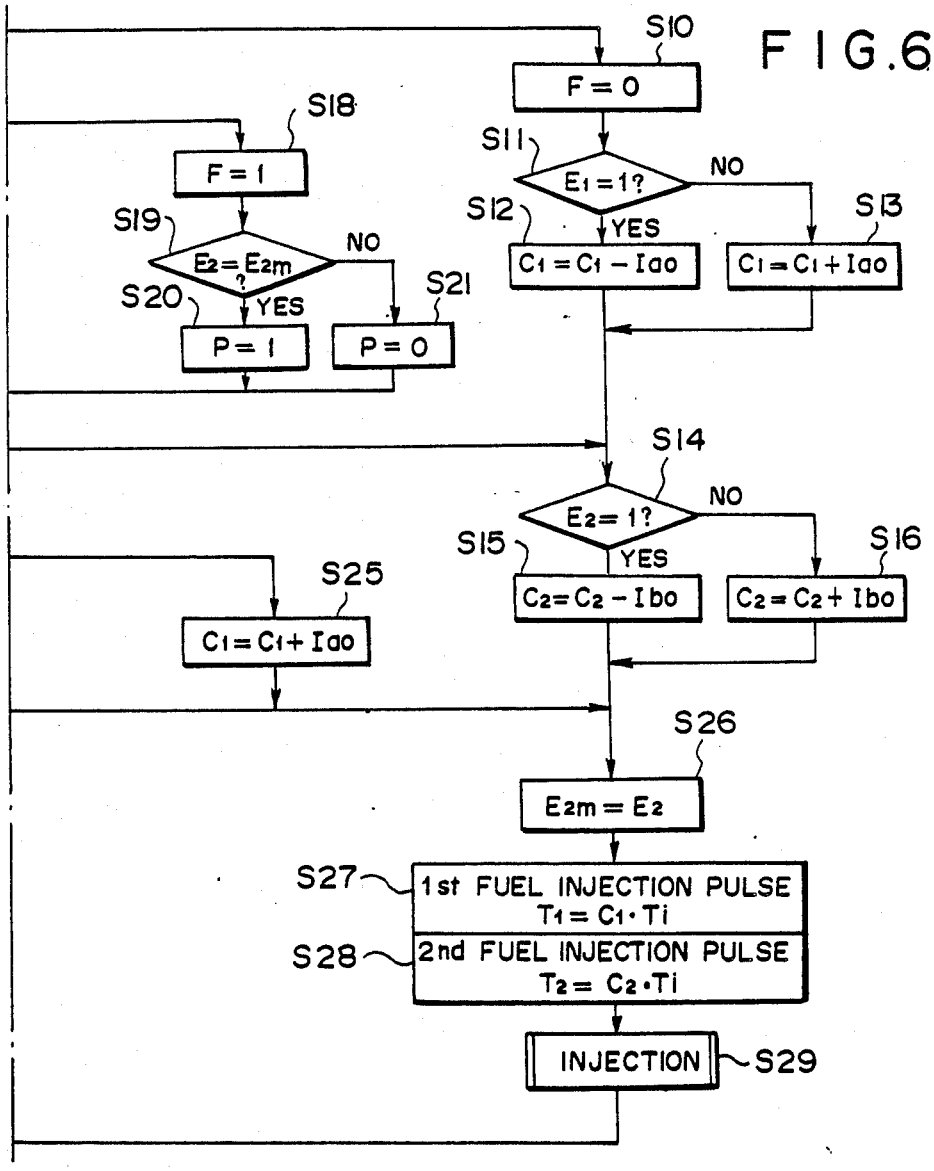
Figure 6A:
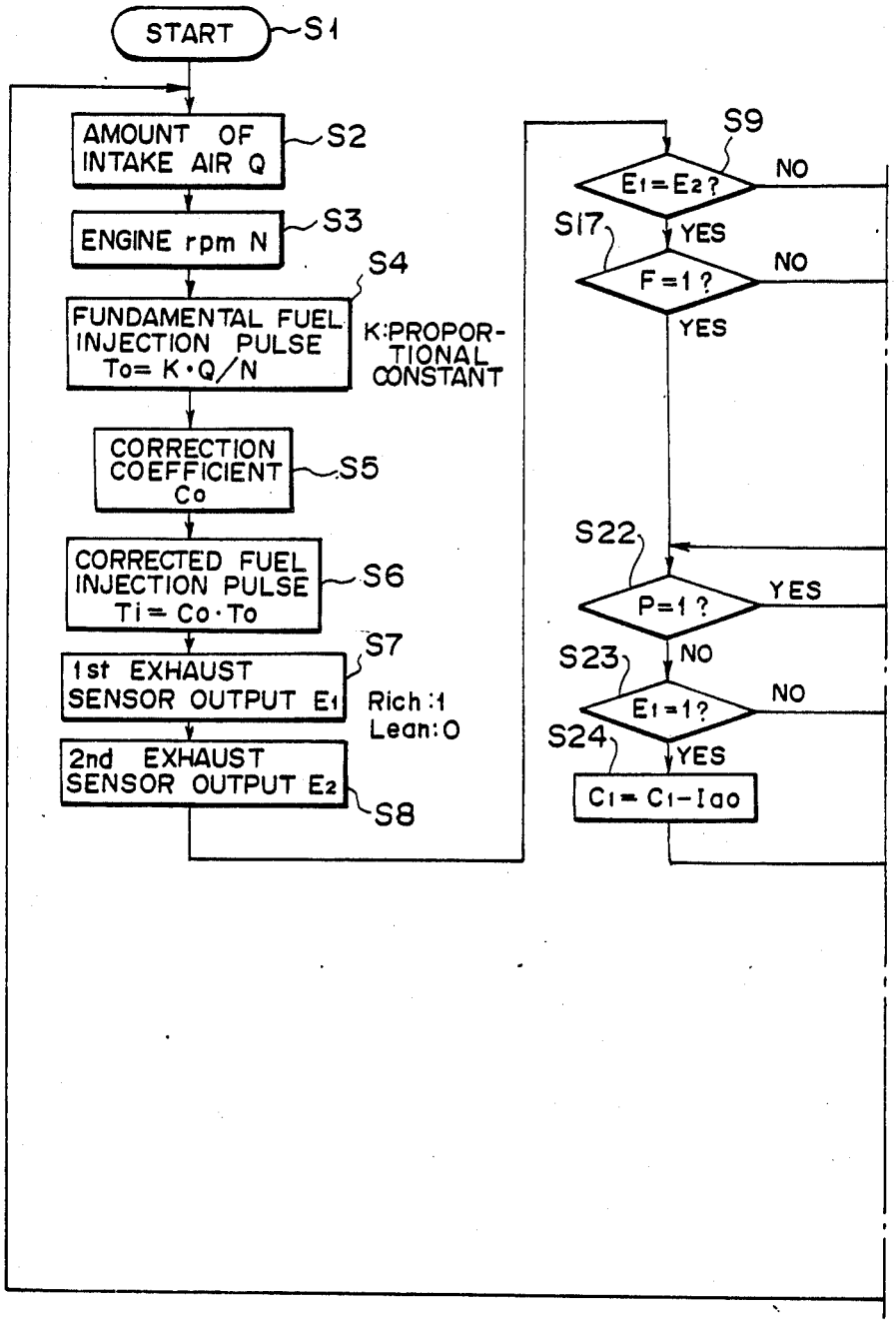

FIG. 6 is a flow chart showing the operation of the control unit 25 in the case of an air-fuel ratio control system in accordance with a fourth embodiment of the present invention in which the air-fuel ratios for the first and second group cylinders are controlled in accordance with the principle described above in conjunction with the lines (L), (M) and (K) in FIG. 1.

In step Sl, flag F is reset (initialized), and then the amount Q of intake air and the engine speed N are read in steps S2 and S3. In step S4, a fundamental fuel injection pulse To to be delivered to the first and second fuel injection valves 23 and 24 is calculated corresponding to a fuel amount requirement. In step S5, a correction coefficient Co for, for instance, temperature correction according to the output of the engine coolant temperature sensor 27, starting correction, acceleration correction or the like is obtained and then corrected fuel injection pulse Ti is calculated in step S6.

In step S7, comparison output E1 of the first exhaust sensor 6 is read, and in step S8, comparison output E2 of the second exhaust sensor 7 is read. The comparison outputs E1 and E2 are "1" signals when the detected air-fuel ratio is richer than a set value, and are "0" signals when the detected air-fuel ratio is leaner than the set value.

The comparison output E1 of the first exhaust sensor 6 and the comparison output E2 of the second exhaust sensor 7 are compared with each other and it is determined whether or not they are in the same phase (both of them are 1 or 0) in step S9. When it is determined that the comparison outputs E1 and E2 are in reverse phases, i.e., the determination in the step S9 is "no", the flag F is reset at "0" in step S10. Thereafter, in step S11, it is determined whether or not the air-fuel ratio for the first group cylinders is richer than the set value through the comparison output E1 of the first exhaust sensor 6. When it is determined that the air-fuel ratio for the first group cylinders is richer than the set value, the correction coefficient C1 is obtained by subtracting the integration constant Iao so that the air-fuel ratio is reduced in step S12. Otherwise, the correction coefficient C1 is obtained by adding the integration constant Iao so that the air-fuel ratio is enriched in step S13. Based on the correction coefficient C1 thus obtained, the first integration signal for the closed loop control of the air-fuel ratio for the first group cylinders is obtained.

In step S14, it is determined whether or not the air-fuel ratio for the second group cylinders is richer than the set value through the comparison output E2 of the second exhaust sensor 7. When it is determined that the air-fuel ratio for the second group cylinders is richer than the set value, the correction coefficient C2 is obtained by subtracting the integration constant Ibo so that the air-fuel ratio is reduced in step S15. Otherwise, the correction coefficient C2 is obtained by adding the integration constant Ibo so that the air-fuel ratio is enriched in step S16. Based on the correction coefficient C2 thus obtained, the second integration signal for the closed loop control of the air-fuel ratio for the second group cylinders is obtained.

In step S26, memory of the second comparison output E2 is rewritten. Thereafter, based on the correction coefficient C1 (first integration signal) obtained in the step S12 or S13 and the correction coefficient C2 (second integration signal) obtained in the step S15 or S16, a final fuel injection pulse T1 for the first group cylinders and a final fuel injection pulse T2 for the second group cylinders are calculated in steps S27 and S28. According to the final fuel injection pulses T1 and T2, the first fuel injection valves 23 for the first group cylinders and the second fuel injection valves 24 for the second group cylinders are driven to inject fuel (step S29). Thus, the air-fuel ratios for the first and second group cylinders are controlled in a closed loop.

In the reverse phase control described above, when one of the outputs of the first and second exhaust sensors 6 and 7 is inverted earlier than the other so that the outputs of the exhaust sensors are in the same phase, the determination of the step S9 turns to "yes". In step S17, it is determined whether or not the first flag F is set at 1. When the flag F is set at 1, one of the integration signals is being held, while when the flag F is 0, no integration signal is being held. When the flag F is 0, the determination of the step S17 is "no" and the control unit 25 proceeds to step S19 after setting the flag F at 1 in step S18. In the step S19, it is determined whether or not said comparison output E2 of the second exhaust sensor 7 is equal to the preceding comparison output E2m of the second exhaust sensor 7 stored in a memory. That is, in the step S19, it is determined whether or not the detected air-fuel ratio is inverted with respect to the set value from the leaner side to the richer side or from the richer side to the leaner side, thereby determining whether the same phase condition is caused by inversion of the comparison output E1 of the first exhaust sensor 6 or by inversion of the comparison output E2 of the second exhaust sensor 7. When it is determined that the comparison output E2 is equal to the preceding comparison output E2m in the step S19, it is considered that the comparison output E1 of the first exhaust sensor 6 is inverted earlier than that of the second exhaust sensor 7. Therefore, a second flag P is set at 1 in step S20 to hold the first integration signal so that the inversion timing of the first integration signal generated based on the output of the first exhaust sensor 6 is delayed to be synchronized with the inversion timing of the output of the second exhaust sensor 7.

When it is not determined that the comparison output E2 is equal to the preceding comparison output E2m in the step S19, it is considered that the comparison output E1 of the second exhaust sensor is inverted earlier than that of the first exhaust sensor 6. Therefore, the second flag P is reset at 0 in step S21 to hold the second integration signal so that the inversion timing of the second integration signal generated based on the output of the second exhaust sensor 7 is delayed to be synchronized with the inversion timing of the output of the first exhaust sensor 6. The value of the flag F is held until the reverse phase condition occurs next.

After the integration signal to be held is determined by setting the second flag P, the control unit 25 proceeds to step S22 and determines whether or not the second flag P set in the step S20 or S21 is at 1.

In the case that the first integration signal is to be held, the determination of the step S22 is "yes" (P=1). Therefore, the control unit 25 proceeds to the step S14 and the closed loop control of the second integration signal corresponding to the comparison output of the second exhaust sensor 7 is accomplished while the closed loop control of the first integration signal is interrupted and the correction coefficient C1 for the first integration signal is fixed.

In the case that the second integration signal is to be held, the determination of the step S22 is "no" (P=0). Therefore, the control unit 25 proceeds to the step S23. The steps S23 to S25 are the same as the steps S11 to S13 and the closed loop control of the first integration signal is accomplished while the closed loop control of the second integration signal is interrupted and the correction coefficient C2 for the second integration signal is fixed.

When the one of the integration signals which is not held is inverted to generate the reverse phase condition, the determination of the step S9 turns to "no", and the flag F is reset at 0 in the step S10. Therefore, the held integration signal is released and the reverse phase closed loop control with the first and second integration signals is accomplished again.

Thus, when the comparison outputs E1 and E2 come to be in the same phase, the one of the first and second integration signals which is inverted earlier is held and when the other integration signal is inverted in the opposite direction to generate the reverse phase condition, the held integration signal is released, whereby the change in the air-fuel ratio for the first group cylinders or the second group cylinders is held so that the air-fuel ratios for the first and second group cylinders are increased and reduced in the reverse phases. Thus, the air-fuel ratios for the first and second group cylinders are controlled in a closed loop maintaining the reverse phase condition.

Though in the embodiment shown in FIG. 6, one of the first and second integration signals is held depending on the inversion timing in order to shorten the holding time, the integration signal to be held may be fixed as the first integration signal or the second integration signal irrespective of the inversion timing.

Further, the integration constants Iao and Ibo for calculating the first and second integration signals may differ in value depending on whether the air-fuel ratio is increased or reduced.

We claim:

1. An air-fuel ratio control system for a multicylinder engine having a first group cylinders, second group cylinders, a first exhaust system connected to the first group cylinders, a second exhaust system connected to the second group cylinders, and fuel feeding means for feeding fuel to the first and second group cylinders, comprising a first exhaust sensor disposed in the first exhaust system, a second exhaust sensor disposed in the second exhaust system, a first air-fuel ratio adjustment means for controlling the air-fuel ratio for the first group cylinders, a second air-fuel ratio adjustment means for controlling the air-fuel ratio for the second group cylinders, a closed loop control means for controlling the first and second air-fuel ratio adjustment means according to first and second integration signals generated respectively based on the outputs of the first and second exhaust sensors, an integration signal detecting means which detects at least one of the first and second integration signals, and a correction means which according to the output of said integration signal detection means, makes a correction for a predetermined period so that at least one of said first and second air-fuel control means is changed from closed loop control to open loop control so that the air-fuel ratios for the first and second group cylinders controlled by said first and second air-fuel ratio adjustment means are increased and reduced in phases reverse to each other.

2. An air-fuel ratio control system as defined in claim 1 in which said correction means comprises a first integration signal detecting means for detecting a signal related to the direction of the first integration signal, an open loop control signal generating means which generates an open loop control signal which is reverse in phase to the first integration signal based on the output of the first integration signal detecting means, and an open loop control means which interrupts the closed loop control of the second air-fuel ratio adjustment means based on the output of the second exhaust sensor and controls the second air-fuel ratio adjustment means according to the open loop control signal in a particular operating condition of the engine.

3. An air-fuel ratio control system as defined in claim 1 in which said correction means comprises an integration signal detecting means for detecting the first and second integration signals, and an integration signal correcting means for correcting at least one of the integration signals according to the output of the integration signal detecting means so that the air-fuel ratios for the first group cylinders and second group cylinders are increased and reduced in phases reverse to each other.

4. An air-fuel ratio control system as defined in claim 3 in which said integration signal correcting means changes the integration constant of one of the first and second integration signals.

5. An air-fuel ratio control system as defined in claim 4 in which said integration signal correcting means measures the time the first and second integration signals are in the same phase and changes the integration constant of one of the integration signals according to the result of the measurement.

6. An air-fuel ratio control system as defined in claim 3 in which said correction means comprises an integration signal detecting means for detecting the first and second integration signals, and an integration signal correcting means for temporarily holding at least one of the integration signals according to the output of the integration signal detecting means so that the air-fuel ratios for the first group cylinders and second group cylinders are increased and reduced in phases reverse to each other.

7. An air-fuel ratio control system as defined in claim 6 in which said integration signal correcting means measures the time the first and second integration signals are in the same phase and holds one of the integration signals for a time corresponding to the result of the measurement.

8. An air-fuel ratio control system as defined in claim 6 in which said integration signal correcting means has an inversion detecting means which detects a signal related to inversion of the first and second integration signals and holds one of the integration signals when the integration signal is inverted and releases the integration signal when the other integration signal is inverted in the direction opposite to the direction of the inversion of said one integration signal at the time it is held.

9. An air-fuel ratio control system for a multicylinder engine having first group cylinders, second group cylinders, a first exhaust system connected to the first group cylinders, a second exhaust system connected to the second group cylinders, and fuel feeding means for feeding fuel to the first and second group cylinders, comprising a first exhaust sensor disposed in the first exhaust system, a second exhaust sensor disposed in the second exhaust system, a first air-fuel ratio adjustment means for controlling the air-fuel ratio for the first group cylinders, a second air-fuel ratio adjustment means for controlling the air-fuel ratio for the second group cylinders, a closed loop control means for controlling the first and second air-fuel ratio adjustment means according to first and second control signals generated respectively based on the outputs of the first and second exhaust sensors, a control signal detecting means for detecting the first and second control signals, and a control signal correcting means for temporarily holding at least one of the control signals according to the output of the control signal detecting means so that the air-fuel ratios for the first group cylinders and second group cylinders are increased and reduced in phases reverse to each other.

10. An air-fuel ratio control system for a multicylinder engine having first group cylinders, second group cylinders, a first exhaust system connected to the first group cylinders, a second exhaust system connected to the second group cylinders, and fuel feeding means for feeding fuel to the first and second group cylinders, comprising a first exhaust sensor disposed in the first exhaust system, a second exhaust sensor disposed in the second exhaust system, a first air-fuel ratio adjustment means for controlling the air-fuel ratio for the first group cylinders, a second air-fuel ratio adjustment means for controlling the air-fuel ratio for the second group cylinders, a closed loop control means for controlling the first and second air-fuel ratio adjustment means according to first and second control signals generated respectively based on the outputs of the first and second exhaust sensors, a control signal detecting means for detecting the first and second control signals, and a control signal correcting means which measures the time the first and second control signals are in the same phase and temporarily holds one of the control signals for a time corresponding to the result of the measurement according to the output of the control signal detecting means so that the air-fuel ratios for the first group cylinders and second group cylinders are increased and reduced in phases reverse to each other.

11. An air-fuel ratio control system for a multicylinder engine having first group cylinders, second group cylinders, a first exhaust system connected to the first group cylinders, a second exhaust system connected to the second group cylinders, and fuel feeding means for feeding fuel to the first and second group cylinders, comprising a first exhaust sensor disposed in the first exhaust system, a second exhaust sensor disposed in the second exhaust system, a first air-fuel ratio adjustment means for controlling the air-fuel ratio for the first group cylinders, a second air-fuel ratio adjustment means for controlling the air-fuel ratio for the second group cylinders, a closed loop control means for controlling the first and second air-fuel ratio adjustment means according to first and second control signals generated respectively based on the outputs of the first and second exhaust sensors, an inversion detecting means which detects a signal related to inversion of the first and second control signals, a control signal correcting means which holds one of the control signals when the control signal is inverted and releases the control signal when the other control signal is inverted in the direction opposite to the direction of the inversion of said one control signal at the time it is held according to the output of the inversion detecting means so that the air-fuel ratios for the first group cylinders and second group cylinders are increased and reduced in phases reverse to each other.

12. An air-fuel ratio control system for a multicylinder engine having first group cylinders, second group cylinders, a first exhaust connected to the first group cylinders, a second exhaust system connected to the second group cylinders, and fuel feeding means for feeding fuel to the first and second group cylinders, comprising a first exhaust sensor disposed in the first exhaust system, a second exhaust sensor disposed in the second exhaust system, a first air-fuel ratio adjustment means for controlling the air-fuel ratio for the first group cylinders, a second air-fuel ratio adjustment means for controlling the air-fuel ratio for the second group cylinders, a closed loop control means for controlling the first and second air-fuel ratio adjustment means respectively according to first and second control signals generated respectively based on the outputs of the first and second exhaust sensors so that the air-fuel ratio is lowered when the output of the corresponding exhaust sensor is larger than a set value and enriched when said output is smaller than said set value, and a correction means which detects at least one of the first and second control signals and makes a correction so that the air-fuel ratios for the first and second group cylinders are increased and reduced in phases reverse to each other, said correction means comprising a first control signal detecting means for detecting a signal related to the direction of the first control signal, an open loop control signal generating means which generates an open loop control signal which is reverse in phase to the first control signal based on the output of the first control signal detecting means, and an open loop control means which interrupts the closed loop control of the second air-fuel ratio adjustment means based on the output of the second exhaust sensor and controls the second air-fuel ratio adjustment means according to the open loop control signal in a particular operating condition of the engine.

13. An air-fuel ratio control system for a multicylinder engine having first group cylinders, second group cylinders, a first exhaust system connected to the first group cylinders, a second exhaust system connected to the second group cylinders, and fuel feeding means for feeding fuel to the first and second group cylinders, comprising a first exhaust sensor disposed in the first exhaust system, a first air-fuel ratio adjustment means for controlling the air-fuel ratio for the first group cylinders, a second air-fuel ratio adjustment means for controlling the air-fuel ratio for the second group cylinders, a closed loop control means for controlling the first and second air-fuel ratio adjustment means respectively according to first and second control signals generated respectively based on the outputs of the first and second exhaust sensors so that the air-fuel ratio is lowered when the output of the corresponding exhaust sensor is larger than a set value and enriched when said output is smaller than said set value, and a correction means comprising a control signal detecting means for detecting the first and second control signals, and a control signal correcting means for correcting at least one of the control signal according to the outputs of the control signal detecting means so that at least one of said first and second air-fuel control means is changed from closed loop control to open loop control so that the air-fuel ratios for the first group cylinders and second group cylinders are increased and reduced in phases reverse to each other.

* * * * *